US009708160B2

(12) United States Patent
Zhu et al.

(10) Patent No.: US 9,708,160 B2
(45) Date of Patent: Jul. 18, 2017

(54) TENSIONING DEVICE AND TENSIONING METHOD FOR STEEL WIRE ROPE OF CAGE GUIDE OF ULTRA-DEEP VERTICAL SHAFT

(71) Applicant: CHINA UNIVERSITY OF MINING AND TECHNOLOGY, Xuzhou (CN)

(72) Inventors: Zhencai Zhu, Xuzhou (CN); Xiao Chen, Xuzhou (CN); Guohua Cao, Xuzhou (CN); Hong Lai, Xuzhou (CN); Wenxiang Teng, Xuzhou (CN); Gang Shen, Xuzhou (CN); Gongbo Zhou, Xuzhou (CN); Wei Li, Xuzhou (CN)

(73) Assignee: CHINA UNIVERSITY OF MINING AND TECHNOLOGY, Xuzhou, Jiangsu (CN)

( * ) Notice: Subject to any disclaimer, the term of this patent is extended or adjusted under 35 U.S.C. 154(b) by 0 days.

(21) Appl. No.: 15/124,266

(22) PCT Filed: Jun. 16, 2015

(86) PCT No.: PCT/CN2015/081523

§ 371 (c)(1),
(2) Date: Sep. 7, 2016

(87) PCT Pub. No.: WO2016/090881

PCT Pub. Date: Jun. 16, 2016

(65) Prior Publication Data

US 2017/0015522 A1 Jan. 19, 2017

(30) Foreign Application Priority Data

Dec. 11, 2014 (CN) ..... 2014 1 0767702

(51) Int. Cl.
*B66B 7/02* (2006.01)
*B66B 1/04* (2006.01)
(Continued)

(52) U.S. Cl.
CPC ..... *B66B 7/02* (2013.01); *B21F 9/002* (2013.01); *B66B 1/04* (2013.01); *B66B 7/025* (2013.01); *E21D 7/02* (2013.01)

(58) Field of Classification Search
CPC ... B66B 7/02; B66B 7/025; E21D 7/02; B21F 9/002
See application file for complete search history.

(56) References Cited

U.S. PATENT DOCUMENTS 3,602,413 A * 8/1971 Reynard ..... E21B 19/22 226/115
4,448,393 A * 5/1984 Habegger ..... B66D 3/006 254/228
4,615,509 A * 10/1986 Biass ..... B66D 3/006 254/228
6,283,451 B1 * 9/2001 Stankus ..... E04G 21/121 254/228
8,826,841 B2 * 9/2014 Moreau ..... B66D 3/006 114/218
(Continued)

FOREIGN PATENT DOCUMENTS

CN 201250036 Y 6/2009
CN 102085993 A 6/2011
(Continued)

OTHER PUBLICATIONS

International Search Report, dated Aug. 21, 2015.

*Primary Examiner* — Minh Truong
(74) *Attorney, Agent, or Firm* — Heslin Rothenberg Farley & Mesiti PC

(57) ABSTRACT

A tensioning device and a tensioning method for a steel wire rope of a cage guide of an ultra-deep vertical shaft. The tensioning device comprises an upper rope clamping device, a rope adjustment guide frame, a lower hydraulic rope locking device, and a lower hydraulic rope adjustment device. The upper rope clamping device is provided with a rope clamp and a pressure sensor. The rope adjustment guide frame comprises a steel frame body, double fixed clamp-plates, a balance weight, and a balance weight steel wire rope. Double moving clamp-plates are disposed in a guide groove of the steel frame body. The double moving clamp-plates are provided with a rope clamp and a lower guide pulley. The double fixed clamp-plates are provided with an upper guide pulley. The balance weight is provided with a fastening joint. Each of the upper rope clamping device, the lower hydraulic rope locking device and the lower hydraulic rope adjustment device comprises a wedged iron block and a shim. Each of the lower hydraulic rope locking device and the lower hydraulic rope adjustment device further comprises a lever wedge adjustment mechanism and a wedge adjustment hydraulic cylinder. A wedge adjustment hydraulic pressing rod is connected to the wedged iron block. The bodies of the wedge adjustment hydraulic cylinders are
(Continued)

connected to the shims. The tensioning device and the tensioning method can be used for implementing automatic adjustment and control of the tensile force of the steel wire rope of the cage guide of the ultra-deep vertical shaft.

4 Claims, 4 Drawing Sheets

(51) Int. Cl.
*B21F 9/00* (2006.01)
*E21D 7/02* (2006.01)

(56) References Cited

U.S. PATENT DOCUMENTS

| | | | |
|---|---|---|---|
| 2013/0233654 | A1 | 9/2013 | Cao et al. |
| 2014/0110194 | A1 | 4/2014 | Zhu et al. |

FOREIGN PATENT DOCUMENTS

| | | | |
|---|---|---|---|
| CN | 102275799 | A | 12/2011 |
| CN | 102701042 | A | 10/2012 |
| CN | 104477734 | A | 4/2015 |
| GB | 1039041 | A | 8/1966 |
| JP | 0891727 | A | 4/1996 |

* cited by examiner

TENSIONING DEVICE AND TENSIONING METHOD FOR STEEL WIRE ROPE OF CAGE GUIDE OF ULTRA-DEEP VERTICAL SHAFT

CROSS REFERENCE TO RELATED APPLICATIONS

This application is a national stage filing under section 371 of International Application No. PCT/CN2015/081523, filed on Jun. 16, 2015, and published in Chinese on Jun. 16, 2016, as WO 2016/090881 A1, which claims priority of Chinese Patent Application No. 201410767702.2 filed on Dec. 11, 2014, the entire content of said applications being hereby incorporated herein by reference.

FIELD OF THE INVENTION

The present invention relates to an assembled steel wire rope tensioner for shaft guides and a tensioning method for the tensioner, which are especially applicable to steel wire rope tensioning in ultra-deep shaft guides, and are also applicable to steel wire rope tensioning in other flexible shaft guides.

BACKGROUND ART

At present, the shaft guide devices associated to the hoisting containers of hoists in the coal mines in China mainly include rigid assembled shaft guides and steel-wire-rope guides. As deep mining in coal mines is developed, rigid assembled shaft guides have been replaced by steel-wire-rope guides, owing to their drawbacks such as high capital investment, difficulties in construction, and difficulties in maintenance and repair after deformation, etc. Since steel wire ropes belong to a flexible material, the wide application of steel-rope guides inevitably brings a problem of shaft guide rope tensioning. Well-known tensioning methods that can effectively provide tensioning force for shaft guide ropes mainly include counterweight tensioning method and hydraulic tensioning method.

Regarding the counterweight tensioning method, usually a counterweight is mounted on the lower part of the shaft guide rope, so as utilize the gravity of the counterweight to provide tensioning force for the shaft guide rope; though the tensioning force is stable, the size of the counterweight has to be increased as the tensioning force is increased; consequently, a large water pocket has to be excavated in the shaft bottom to accommodate the counterweight; in addition, the counterweight may fall into the water pocket in the shaft bottom; once such a problem occurs, it is difficult to repair, and the production may be delayed; regarding the hydraulic tensioning method, usually a hydraulic cylinder is arranged on the shaft-head frame, a lifting rope clamp devices are used to provide tensioning force for the steel wire rope. Though the tensioning force on the shaft guide rope can be adjusted well with that method, the hydraulic cylinder arranged at the shaft head has to bear the weight of the steel wire rope having a length of thousands of meters while providing increasing tensioning force as the mining depth is increased; consequently, the cost will be increased vehemently; in addition, it is difficult to arrange the hydraulic station, owing to the large size of the hydraulic station.

It can be seen from the above analysis that the existing tensioners cannot meet the requirement at present and in the future.

CONTENTS OF THE INVENTION

Object of the invention: in view of the drawbacks in the prior art, the present invention provides an ultra-deep shaft guide steel wire rope tensioner and a tensioning method for the tensioner, which can realize automatic regulation and control of the tensioning force on the ultra-deep shaft guide steel wire rope.

To attain the object described above, the present invention employs the following technical scheme: an ultra-deep shaft guide steel wire rope tensioner, comprising an upper rope clamping device, a rope adjusting guide frame, a lower hydraulic rope locking device, and lower hydraulic rope adjusting device, the upper rope clamping device is fixed to a hoisting sheave head frame by a set of symmetric bolts, a rope clamp is mounted on the upper part of the upper rope clamping device, a pressure sensor is arranged at the bottom of the upper rope clamping device, and the pressure sensor is connected to a control console; the rope adjusting guide frame comprises a steel frame body, an upper fixed double clamp plate is welded on the upper part of the steel frame body, an upper guide sheave is arranged on the upper fixed double clamp plate, a guide slot is opened in the middle part of the steel frame body, slideable moving double clamp plate is arranged in the guide slot, a rope clamp is arranged in the moving double clamp plate, a lower guide sheave is fixed on the lower part of the moving double clamp plate, counterweights are arranged at each sides of the steel frame body, a tightening joint is arranged on the lower part of the counterweight, one end of the counterweighted steel wire rope is connected to the tightening joint, and the other end of the counterweighted steel wire rope passes through the counterweight, the upper guide sheave, the lower guide sheave, and the rope clamp sequentially; the lower hydraulic rope locking device is fixed to the fixed double clamp plate on the rope adjusting guide frame by a set of bolts, the upper part of the lower hydraulic rope adjusting device is connected to the moving double clamp plate by bolts, a connecting plate is fixed to a side of the lower hydraulic rope adjusting device by bolts, a push plate is connected to the connecting plate by bolts, and the push plate is connected to the upper part of a square threaded disk by a set of bolts, a threaded hole is arranged in the lower part of the square threaded disk, and the square threaded disk is thread-connected to the upper end of the hydraulic rod of a tensioning hydraulic cylinder, and the base of the tensioning hydraulic cylinder is fixed to a base of the rope adjusting guide frame by a set of symmetric bolts; all of the upper rope clamping device, the lower hydraulic rope locking device, and the lower hydraulic rope adjusting device comprise wedge-shaped iron blocks and shims, a front clamp plate, and a back clamp plate, the shims are fixed between the front clamp plate and the back clamp plate by a set of bolts, a tapered slot that matches the shape of the wedge-shaped iron block is arranged in each shim, the wedge-shaped iron block is inserted into the tapered slot, and a roller grate is arranged at the contact surface between the wedge-shaped iron block and the tapered slot; the lower hydraulic rope locking device and the lower hydraulic rope adjusting device further comprise a wedge-adjusting lever mechanism and a wedge-adjusting hydraulic cylinder respectively, the hydraulic rod of the wedge-adjusting hydraulic cylinder is connected to the wedge-shaped iron block via the wedge-adjusting lever mechanism, and the cylinder body of the wedge-adjusting hydraulic cylinder is connected to the shim; the tensioning hydraulic cylinder and the wedge-adjusting hydraulic cylinder are connected to a hydraulic pump station respectively, and the hydraulic pump station is connected to the control console.

In the present invention, preferably the wedge-adjusting lever mechanism comprises a lever connecting plate, which has a slide slot at each end; the wedge-adjusting hydraulic cylinders are arranged at the two sides of the lower hydraulic rope locking device and the lower hydraulic rope adjusting device, hydraulic cylinder dual-lug rings are arranged at the two sides of the shim, a shim dual-lug ring is arranged on the lower part of the shim, a wedge block dual-lug ring is arranged on the lower part of the wedge-shaped iron block, a threaded connector is arranged on the end of the hydraulic rod of the wedge-adjusting hydraulic cylinder, the hydraulic cylinder dual-lug rings are connected to the cylinder body of the wedge-adjusting hydraulic cylinder, the shim dual-lug ring is connected to the middle part of the lever connecting plate via a pin shaft, the wedge dual-lug ring is connected to the slide slot at one end of the lever connecting plate via the pin shaft, and the threaded connector is connected to the slide slot at the other end of the lever connecting plate via the pin shaft.

A tensioning method for the above-mentioned ultra-deep shaft guide steel wire rope tensioner, wherein, when the steel wire rope is at a normal working state, the upper rope clamping device and the lower hydraulic rope adjusting device lock the steel wire rope, the lower hydraulic rope locking device releases the steel wire rope, the lower hydraulic rope adjusting device and the counterweights work together to provide tensioning force, the sensor sends measured tensioning force signal to the control console, and the following operations are carried out, according to the magnitude of the measured tensioning force:

When the tensioning force is smaller than 97% of a preset tensioning force value, the hydraulic rod of the tensioning hydraulic cylinder at the lower hydraulic rope adjusting device will retract, and thereby tension up the steel wire rope so that the tensioning force is increased, till the tensioning force reaches to 97% of the preset tensioning force value to cease the action of tensioning up the hydraulic cylinder; when the tensioning force is greater than 103% of the preset tensioning force value, the hydraulic rod of the tensioning hydraulic cylinder at the lower hydraulic rope adjusting device will elongate, and thereby loosen up the steel wire rope so that the tensioning force is decreased, till the tensioning force reaches to 103% of the preset tensioning force value to cease the action of tensioning up the hydraulic cylinder; when the tensioning force is greater than or equal to 97% of the preset tensioning force value and smaller than or equal to 103% of the preset tensioning force value, the tensioning will be terminated.

In the present invention, preferably the tensioning hydraulic cylinder is arranged with an upper stroke control switch and a lower stroke control switch for the telescopic rod;

When the hydraulic rod of the tensioning hydraulic cylinder retracts to a limit position, the lower stroke control switch will be triggered, the lower hydraulic rope locking device will lock up the steel wire rope, the lower hydraulic rope adjusting device will release the steel wire rope, meanwhile the hydraulic rod of the tensioning hydraulic cylinder will extend to reset; when the hydraulic rod of the tensioning hydraulic cylinder extends to a limit position, the upper stroke control switch will be triggered, the lower hydraulic rope adjusting device will lock up the steel wire rope, and the lower hydraulic rope locking device will release the steel wire rope, so that the tensioning action of the tensioning hydraulic cylinder will be repeated;

When the hydraulic rod of the tensioning hydraulic cylinder extends to a limit position, the upper stroke control switch will be triggered, the lower hydraulic rope locking device will lock up the steel wire rope, the lower hydraulic rope adjusting device will release the steel wire rope, and the hydraulic rod of the tensioning hydraulic cylinder will retract to reset; when the hydraulic rod of the tensioning hydraulic cylinder retracts to a limit position, the lower stroke control switch will be triggered, the lower hydraulic rope adjusting device will lock up the steel wire rope, and the lower hydraulic rope locking device will release the steel wire rope, so that the tensioning action of the tensioning hydraulic cylinder will be repeated.

Beneficial effects: The present invention employs a downhole arrangement for the steel-rope guide, so that the tensioner does not have to bear an additional load, i.e., the self-weight of the steel wire rope; in addition, the present invention employs a combined tensioning method, which incorporates counterweight tensioning and hydraulic tensioning; thus, the space occupation is reduced, the requirement for the hydraulic system is decreased; hence, the space cost is saved, and the tensioning force on the steel wire rope can be effectively monitored, controlled, and adjusted. Compared with the prior art, the apparatus provided in the present invention has simple structure, reliable performance, and low cost, and achieves automatic rope regulation, low cost. Therefore, the apparatus has high practicability.

Figure 1:
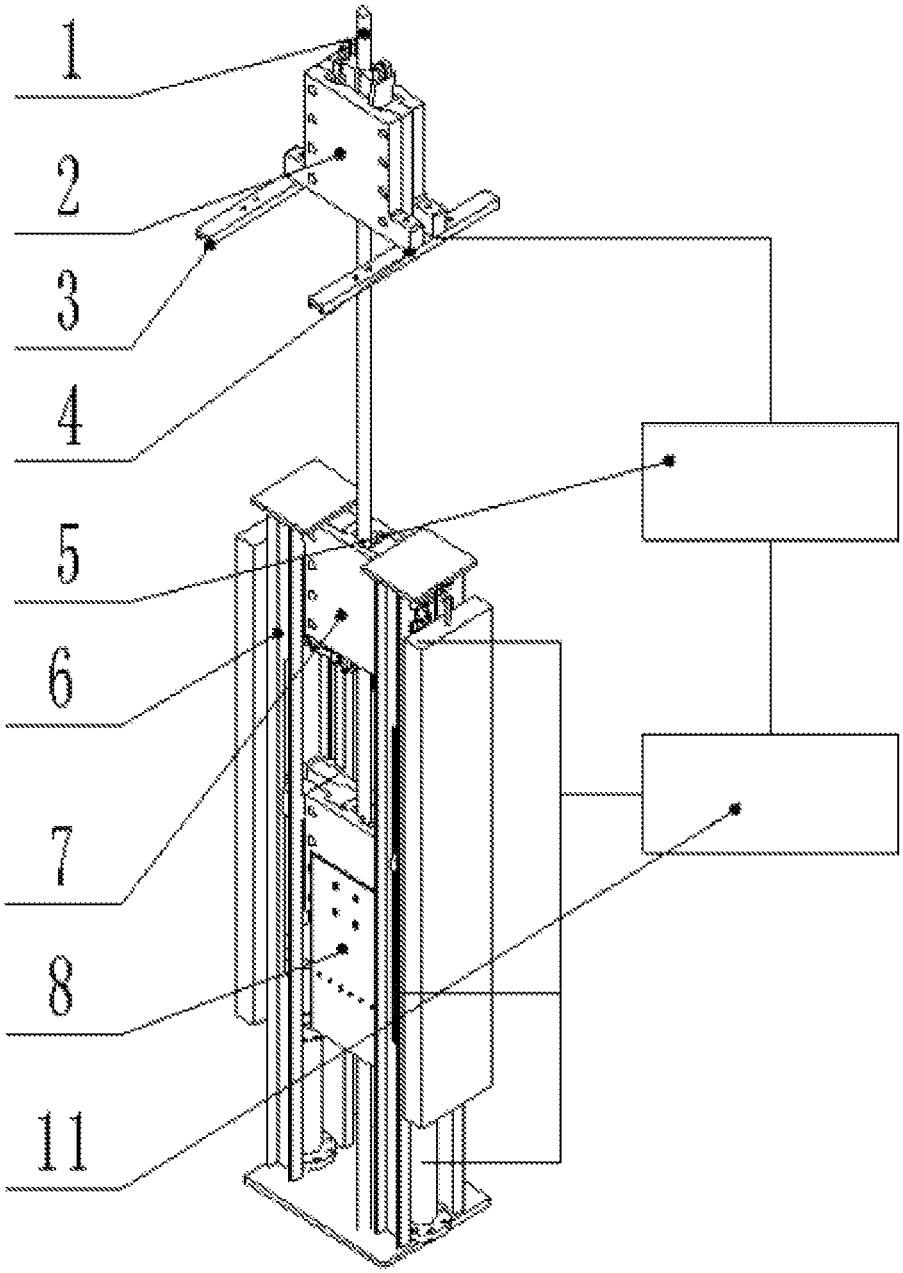
FIG. 1 is a 3D structural diagram of the shaft guide steel wire rope tensioner according to the present invention.

In the figures: 1—steel wire rope; 2—upper rope clamping device; 2-1—rope clamp; 2-2—wedge-shaped iron block; 2-3—shim; 2-4—roller grate; 2-5—symmetric bolt set; 2-6—bolt set; 2-7—front clamp plate; 2-8—back clamp plate; 3—hoisting sheave headframe; 4—pressure sensor; 5—control console; 6—rope adjusting guide frame; 6-1—fixed double clamp plate; 6-2—upper guide sheave; 6-3—steel frame body; 6-4—counterweight; 6-5—guide slot; 6-6—moving double clamp plate; 6-7—counterweighted steel wire rope; 6-8—rope clamp; 6-9—lower guide sheave; 6-10—tightening joint; 7—lower hydraulic rope locking device; 7-1—bolt set; 7-2—hydraulic cylinder connecting lug ring; 7-3—wedge-adjusting hydraulic cylinder; 7-4—threaded connector; 7-5—wedge-adjusting lever mechanism; 7-7—shim dual-lug ring; 7-8—wedge dual-lug ring; 8—lower hydraulic rope adjusting device; 8-1—bolt; 8-2—connecting bolt; 8-3—push plate; 8-4—bolt set; 8-5—square threaded disk; 8-6—tensioning hydraulic cylinder; 8-7—symmetric bolt set; 9—connecting plate; 9-1—bolt; 10-1—slide slot; 10-2—pin shaft; 10-3—lever connecting plate; 11—hydraulic pump station.

DETAILED DESCRIPTION OF THE EMBODIMENTS

Hereunder the present invention will be further detailed, with reference to the accompanying drawings.

As shown in FIGS. 1-4, the present invention provides an ultra-deep shaft guide steel wire rope tensioner, comprising an upper rope clamping device 2, a rope adjusting guide frame 6, a lower hydraulic rope locking device 7, and lower hydraulic rope adjusting device 8.

The upper rope clamping device 2 is fixed to a hoisting sheave headframe 3 by a set of symmetric bolts 2-5, a rope clamp 2-1 is mounted on the upper part of the upper rope clamping device 2, a pressure sensor 4 is arranged at the bottom of the upper rope clamping device 2, and the pressure sensor 4 is connected to a control console 5 via a wireless signal emission module, to transmit pressure signals to the control console 5. The rope adjusting guide frame 6 comprises a steel frame body 6-3, a fixed double clamp plate 6-1 is welded on the upper part of the steel frame body 6-3, an upper guide sheave 6-2 is arranged on the fixed double clamp plate 6-1, a guide slot 6-5 is opened in the middle part of the steel frame body 6-3, a slideable moving double clamp plate 6-6 is arranged in the guide slot 6-5, a rope clamp 6-8 is arranged in the moving double clamp plate 6-6, a lower guide sheave 6-9 is fixed on the lower part of the moving double clamp plate 6-6, a counterweight 6-4 is arranged at each of the two sides of the steel frame body 6-3, a tightening joint 6-10 is arranged on the lower part of the counterweight 6-4, one end of the counterweighted steel wire rope 6-7 is connected to the tightening joint 6-10, and the other end of the counterweighted steel wire rope 6-7 passes through the counterweight 6-4, the upper guide sheave 6-2, the lower guide sheave 6-9, and the rope clamp 6-8 sequentially.

The lower hydraulic rope locking device 7 is fixed on a fixed double clamp plate 6-1 of the rope adjusting guide frame 6 by a set of bolts 7-1, the upper part of the lower hydraulic rope adjusting device 8 is connected to the moving double clamp plate 6-6 by bolts 8-1, and the lower hydraulic rope adjusting device 8 can move up and down along the guide slot 6-5 with the moving double clamp plate 6-6. A fixed connecting plate 9 is connected to a side of the lower hydraulic rope adjusting device 8 by bolts 9-1, a push plate 8-3 is connected to the connecting plate 9 by connecting bolts 8-2, and the push plate 8-3 is connected to the upper part of a square threaded disk 8-5 by a set of bolts 8-4, a threaded hole is arranged in the lower part of the square threaded disk 8-5, and the square threaded disk is thread-connected to the upper end of the hydraulic rod of the tensioning hydraulic cylinder 8-6, and the base of the tensioning hydraulic cylinder 8-6 is fixed to a base of the rope adjusting guide frame 6 by a set of symmetric bolts 8-7. All of the upper rope clamping device 2, the lower hydraulic rope locking device 7, and the lower hydraulic rope adjusting device 8 comprise two wedge-shaped iron blocks 2-2 and shims 2-3, a front clamp plate 2-7, and a back clamp plate 2-8, the shims 2-3 are fixed between the front clamp plate 2-7 and the back clamp plate 2-8 by a set of bolts 2-6, a tapered slot that matches the shape of the wedge-shaped iron block 2-2 is arranged in each shim 2-3, the wedge-shaped iron block 2-2 is inserted into the tapered slot, and a roller grate 2-4 is arranged at the contact surface between the wedge-shaped iron block 2-2 and the tapered slot. The lower hydraulic rope locking device 7 and the lower hydraulic rope adjusting device 8 further comprise a wedge-adjusting lever mechanism 7-5 and a wedge-adjusting hydraulic cylinder 7-3 respectively, the hydraulic rod of the wedge-adjusting hydraulic cylinder 7-3 is connected to the wedge-shaped iron block 2-2 via the wedge-adjusting lever mechanism 7-5, and the cylinder body of the wedge-adjusting hydraulic cylinder 7-3 is connected to the shim 2-3; the tensioning hydraulic cylinder 8-6 and the wedge-adjusting hydraulic cylinder 7-3 are connected to a hydraulic pump station 11 respectively, and the hydraulic pump station 11 is connected to the control console 5.

Figure 5:
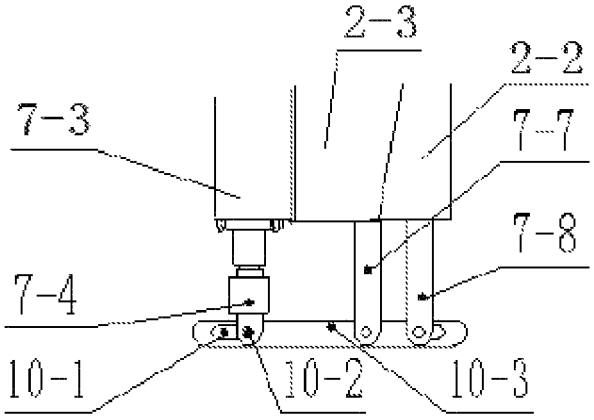
FIG. 5 is a detail drawing of the lever mechanism of the shaft guide steel wire rope tensioner according to the present invention.

As shown in FIG. 5, the wedge-adjusting lever mechanism 7-5 comprises a lever connecting plate 10-3, which has a slide slot 10-1 at each end; the wedge-adjusting hydraulic cylinders 7-3 are arranged at the two sides of the lower hydraulic rope locking device 7 and the lower hydraulic rope adjusting device 8, hydraulic cylinder dual-lug rings 7-2 are arranged at the two sides of the shim 2-3, a shim dual-lug ring 7-7 is arranged on the lower part of the shim 2-3, a wedge block dual-lug ring 7-8 is arranged on the lower part of the wedge-shaped iron block 2-2, a threaded connector 7-4 is arranged on the end of the hydraulic rod of the wedge-adjusting hydraulic cylinder 7-3, the hydraulic cylinder dual-lug rings 7-2 are connected to the cylinder body of the wedge-adjusting hydraulic cylinder 7-3, the shim dual-lug ring 7-7 is connected to the middle part of the lever connecting plate 10-3 via a pin shaft 10-2, the wedge dual-lug ring 7-8 is connected to the slide slot 10-1 at one end of the lever connecting plate 10-3 via the pin shaft 10-2, and the threaded connector 7-4 is connected to the slide slot 10-1 at the other end of the lever connecting plate 10-3 via the pin shaft 10-2.

Figure 2:
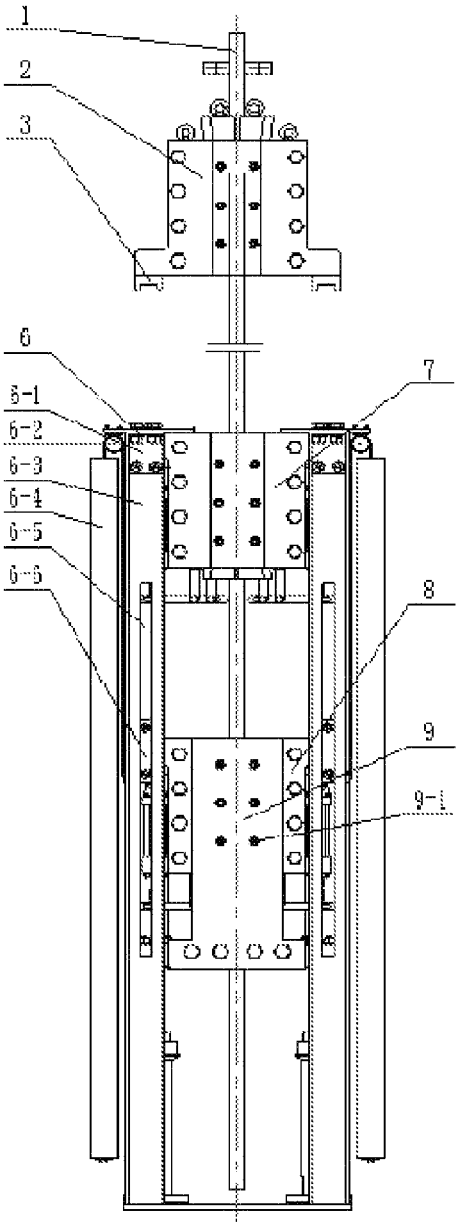
FIG. 2 is a front view of the shaft guide steel wire rope tensioner according to the present invention.
Figure 3:
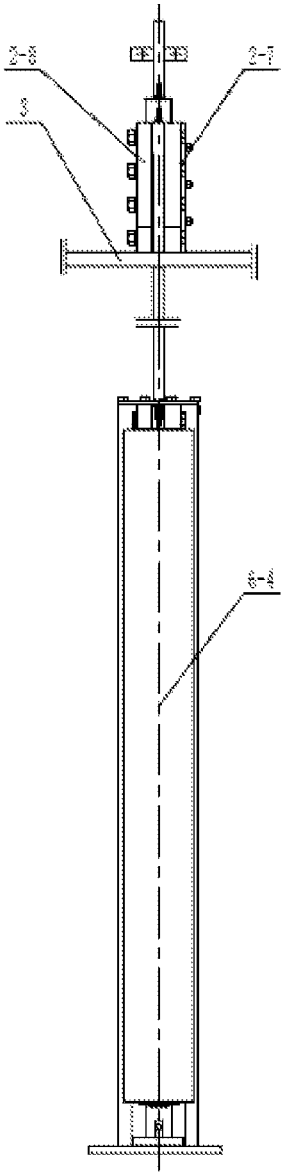
FIG. 3 is a side view of the shaft guide steel wire rope tensioner according to the present invention.
Figure 4:
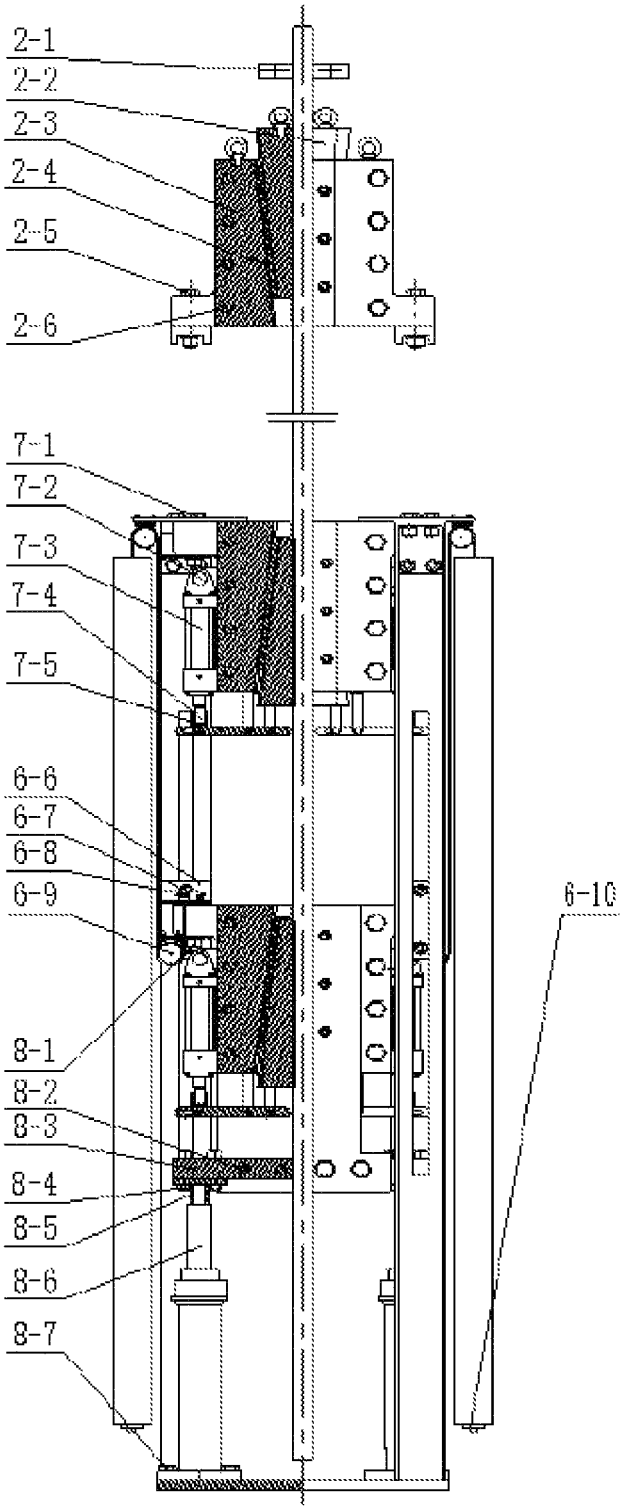
FIG. 4 is a sectional view of the structure of the shaft guide steel wire rope tensioner according to the present invention.

As shown in FIGS. 1, 2 and 4, under the driving action of the pumping station 11, the actions of the tensioning hydraulic cylinder 8-6 can be controlled to adjust the up-down movement of the lower hydraulic rope adjusting device 8.

As shown in FIG. 4, all of the rope clamping device 2, the lower hydraulic rope locking device 7, and the lower hydraulic rope adjusting device 8 utilize a wedge self-locking principle to lock up the steel wire rope 1 by means of the wedge-shaped iron blocks 2-2. When the steel wire rope 1 moves upwards under the tensioning effect, it drives the two wedge-shaped iron blocks 2-2 to move upwards; in the upward movement process, the wedge-shaped iron blocks 2-2 gradually increases the acting force on the steel wire rope 1 and thereby the steel wire rope 1 cannot escape, as the constraining clearance in the tapered slot of the shim 2-3 gradually decreases.

As shown in FIGS. 1, 4 and 5, under the driving effect of the pumping station 11, the actions of the wedge-adjusting hydraulic cylinder 7-3 can be controlled to adjust the tightness of the wedge-shaped iron blocks 2-2, so as to lock up or loosen up the steel wire rope 1.

The tensioning method for the ultra-deep shaft guide steel wire rope tensioner in the present invention is as follows: when the steel wire rope 1 is in a normal working state, the upper rope clamping device 2 and the lower hydraulic rope adjusting device 8 lock the steel wire rope 1, the lower hydraulic rope locking device 7 releases the steel wire rope 1, the lower hydraulic rope adjusting device 8 and the counterweights 6-4 work together to provide tensioning force, the sensor 4 sends measured tensioning force signal to the control console 5, and the following operations are carried out, according to the magnitude of the measured tensioning force:

When the tensioning force is smaller than 97% of a preset tensioning force value, the hydraulic rod of the tensioning hydraulic cylinder 8-6 at the lower hydraulic rope adjusting device 8 will retract, and thereby tension up the steel wire rope 1 so that the tensioning force is increased, till the tensioning force reaches to 97% of the preset tensioning force value to ceasing action of tensioning hydraulic cylinder 8-6; when the tensioning force is greater than 103% of the preset tensioning force value, the hydraulic rod of the tensioning hydraulic cylinder 8-6 at the lower hydraulic rope adjusting device 8 will extend, and thereby loosen up the steel wire rope 1 so that the tensioning force is decreased, till the tensioning force reaches to 103% of the preset tensioning force value to ceasing action of tensioning hydraulic cylinder 8-6; when the tensioning force is greater than or equal to 97% of the preset tensioning force value and smaller than or equal to 103% of the preset tensioning force value, the tensioning will be terminated.

The tensioning hydraulic cylinder 8-6 is arranged with an upper stroke control switch and a lower stroke control switch for the telescopic rod, in order to improve the tensioning force adjusting range of the hydraulic rope adjusting device 8 on the steel wire rope 1, and prevent a phenomenon that the tensioning force still does not meet the requirement when the hydraulic rod of the tensioning hydraulic cylinder 8-6 reaches a limit position.

When the hydraulic rod of the tensioning hydraulic cylinder 8-6 retracts to a limit position, the lower stroke control switch will be triggered, the lower hydraulic rope locking device 7 will lock up the steel wire rope 1, the lower hydraulic rope adjusting device 8 will release the steel wire rope 1, meanwhile the hydraulic rod of the tensioning hydraulic cylinder 8-6 will extend to reset; when the hydraulic rod of the hydraulic cylinder 8-6 extends to a limit position, the upper stroke control switch will be triggered, the lower hydraulic rope adjusting device 8 will lock up the steel wire rope 1, and the lower hydraulic rope locking device 7 will release the steel wire rope 1, so that the tensioning action of the tensioning hydraulic cylinder 8-6 will be repeated.

When the hydraulic rod of the tensioning hydraulic cylinder 8-6 extends to a limit position, the upper stroke control switch will be triggered, the lower hydraulic rope locking device 7 will lock up the steel wire rope, the lower hydraulic rope adjusting device 8 will release the steel wire rope 1, meanwhile the hydraulic rod of the tensioning hydraulic cylinder 8-6 will retract to reset; when the hydraulic rod of the hydraulic cylinder 8-6 retracts to a limit position, the lower stroke control switch will be triggered, the lower hydraulic rope adjusting device 8 will lock up the steel wire rope 1, and the lower hydraulic rope locking device 7 will release the steel wire rope 1, so that the tensioning action of the tensioning hydraulic cylinder 8-6 will be repeated.

While the present invention has been illustrated and described with reference to some preferred embodiments, the present invention is not limited to these. Those skilled in the art should recognize that various variations and modifications can be made without departing from the spirit and scope of the present invention. All of such variations and modifications shall be deemed as falling into the protected scope of the present invention.

The invention claimed is:

1. An ultra-deep shaft guide steel wire rope tensioner, comprising: an upper rope clamping device, a rope adjusting guide frame, a lower hydraulic rope locking device, and a lower hydraulic rope adjusting device, the upper rope clamping device is fixed to a hoisting sheave headframe by a set of symmetric bolts, a rope clamp is mounted on an upper part of the upper rope clamping device, a pressure sensor is arranged at a bottom of the upper rope clamping device, and the pressure sensor is connected to a control console; the rope adjusting guide frame comprises a steel frame body, a fixed double clamp plate is welded on an upper part of the steel frame body, an upper guide sheave is arranged on the fixed double clamp plate, a guide slot is opened in a middle part of the steel frame body, a slideable moving double clamp plate is arranged in the guide slot, a rope clamp is arranged in the moving double clamp plate, a lower guide sheave is fixed on a lower part of the moving double clamp plate, a counterweight is arranged at each of two sides of the steel frame body, a tightening joint is arranged on a lower part of the counterweight, one end of a counterweighted steel wire rope is connected to the tightening joint, and other end of the counterweighted steel wire rope passes through the counterweight, the upper guide sheave, the lower guide sheave, and the rope clamp sequentially; the lower hydraulic rope locking device is fixed to the fixed double clamp plate on the rope adjusting guide frame by a set of bolts, an upper part of the lower hydraulic rope adjusting device is connected to the moving double clamp plate by bolts, a connecting plate is fixed to a side of the lower hydraulic rope adjusting device by bolts, a push plate is connected to the connecting plate by bolts, and the push plate is connected to an upper part of a square threaded disk by a set of bolts, a threaded hole is arranged in a lower part of the square threaded disk, and the square threaded disk is thread-connected to an upper end of a hydraulic rod of a tensioning hydraulic cylinder, and a base of the tensioning hydraulic cylinder is fixed to a base of the rope adjusting guide frame by a set of symmetric bolts; each of the upper rope clamping device, the lower hydraulic rope locking device, and the lower hydraulic rope adjusting device comprises a wedge-shaped iron block and a shim, a front clamp plate, and a back clamp plate, the shims are fixed between the front clamp plate and the back clamp plate by a set of bolts, a tapered slot that matches a shape of the wedge-shaped iron block is arranged on each shim, the wedge-shaped iron block is inserted into the tapered slot, and a roller grate is arranged at a contact surface between the wedge-shaped iron block and the tapered slot; the lower hydraulic rope locking device and the lower hydraulic rope adjusting device each further comprises two wedge-adjusting lever mechanisms and two wedge-adjusting hydraulic cylinders, wherein a hydraulic rod of the wedge-adjusting hydraulic cylinder is connected to the wedge-shaped iron block via the wedge-adjusting lever mechanism, and a cylinder body of the wedge-adjusting hydraulic cylinder is connected to the shim; the tensioning hydraulic cylinder and the wedge-adjusting hydraulic cylinder are connected to a hydraulic pump station respectively, and the hydraulic pump station is connected to a control console.

2. The ultra-deep shaft guide steel wire rope tensioner according to claim 1, wherein each of the wedge-adjusting lever mechanisms comprises a lever connecting plate, which has a slide slot at each end; the wedge-adjusting hydraulic cylinders are arranged at opposite sides of the lower hydraulic rope locking device and the lower hydraulic rope adjusting device, hydraulic cylinder dual-lug rings are arranged at opposite sides of the shim, a shim dual-lug ring is arranged on a lower part of the shim, a wedge dual-lug ring is arranged on a lower part of the wedge-shaped iron block, a threaded connector is arranged on an end of the hydraulic rod of the wedge-adjusting hydraulic cylinder, the hydraulic cylinder dual-lug rings are connected to the cylinder body of the wedge-adjusting hydraulic cylinder, the shim dual-lug ring is connected to a middle part of the lever connecting plate via a second pin shaft, the wedge dual-lug ring is connected to the slide slot at one end of the lever connecting plate via the pin shaft, and the threaded connector is connected to the slide slot at the other end of the lever connecting plate via a third pin shaft.

3. A steel wire rope tensioning method for the ultra-deep shaft guide steel wire rope tensioner according to the claim 1, wherein, when the steel wire rope is in a normal working state, the upper rope clamping device and the lower hydraulic rope adjusting device lock up the steel wire rope, the lower hydraulic rope locking device releases the steel wire rope, the lower hydraulic rope adjusting device and the counterweights work together to provide tensioning force, the sensor sends measured tensioning force signal to the control console, and the following tensioning operations are carried out, according to a magnitude of the measured tensioning force:

when the tensioning force is smaller than 97% of a preset tensioning force value, the hydraulic rod of the tensioning hydraulic cylinder at the lower hydraulic rope adjusting device will retract, and thereby tension up the steel wire rope so that the tensioning force is increased, till the tensioning force reaches to 97% of the preset tensioning force value to cease action of tensioning hydraulic cylinder; when the tensioning force is greater than 103% of the preset tensioning force value, the hydraulic rod of the tensioning hydraulic cylinder at the lower hydraulic rope adjusting device will extend, and thereby loosen up the steel wire rope so that the tensioning force is decreased, till the tensioning force reaches to 103% of the preset tensioning force value to cease action of tensioning hydraulic cylinder; when the tensioning force is greater than or equal to 97% of the preset tensioning force value and smaller than or equal to 103% of the preset tensioning force value, the tensioning operations will be terminated.

4. The steel wire rope tensioning method according to claim 3, wherein the tensioning hydraulic cylinder comprises an upper stroke control switch and a lower stroke control switch for a telescopic rod; and further comprising a method step selected from the following:

(1) when the hydraulic rod of the tensioning hydraulic cylinder retracts to a retraction limit position, the lower stroke control switch will be triggered, the lower hydraulic rope locking device will lock up the steel wire rope, the lower hydraulic rope adjusting device will release the steel wire rope, meanwhile the hydraulic rod of the tensioning hydraulic cylinder will extend to reset; when the hydraulic rod of the tensioning hydraulic cylinder extends to an extension limit position, the upper stroke control switch will be triggered, the lower hydraulic rope adjusting device will lock up the steel wire rope, and the lower hydraulic rope locking device will release the steel wire rope, so that the tensioning action of the tensioning hydraulic cylinder will be repeated; and (2) when the hydraulic rod of the tensioning hydraulic cylinder extends to the extension limit position, the upper stroke control switch will be triggered, the lower hydraulic rope locking device will lock up the steel wire rope, the lower hydraulic rope adjusting device will release the steel wire rope, meanwhile the hydraulic rod of the tensioning hydraulic cylinder will retract to reset; when the hydraulic rod of the tensioning hydraulic cylinder retracts to the retraction limit position, the lower stroke control switch will be triggered, the lower hydraulic rope adjusting device will lock up the steel wire rope, and the lower hydraulic rope locking device will release the steel wire rope, so that the tensioning action of the tensioning hydraulic cylinder will be repeated.

* * * * *